United States Patent [19]

Tsukamoto et al.

[11] Patent Number: 4,851,855

[45] Date of Patent: Jul. 25, 1989

[54] PLANAR ANTENNA

[75] Inventors: Katsuya Tsukamoto; Kyozi Masamoto, both of Hirakata; Yasuhiro Fujii, Ibaraki; Yoshihiro Kitsuda, Hirakata, all of Japan

[73] Assignee: Matsushita Electric Works, Ltd., Osaka, Japan

[21] Appl. No.: 15,009

[22] Filed: Feb. 17, 1987

[30] Foreign Application Priority Data

Feb. 25, 1986 [JP] Japan ..... 61-40907

[51] Int. Cl.[4] ..... H01Q 1/38

[52] U.S. Cl. ..... 343/700 MS; 343/873; 343/846

[58] Field of Search ..... 343/700 MS, 872, 873, 343/786, 778, 795, 846, 829, 830

[56] References Cited

U.S. PATENT DOCUMENTS

| | | | |
|---|---|---|---|
| 3,475,107 | 10/1969 | Auxier | 415/115 |
| 3,747,114 | 7/1973 | Shyhalla | 343/795 |
| 3,778,717 | 12/1973 | Okoshi et al. | 343/700 MS |
| 4,477,813 | 10/1984 | Wise | 343/700 MS |
| 4,614,947 | 9/1986 | Rammos | 343/786 |
| 4,623,893 | 11/1986 | Sabban | 343/700 MS |
| 4,633,262 | 12/1986 | Traut | 343/700 MS |
| 4,724,443 | 2/1988 | Nysen | 343/700 MS |
| 4,761,654 | 8/1988 | Zaghloul | 343/700 MS |

FOREIGN PATENT DOCUMENTS

| | | | |
|---|---|---|---|
| 130605 | 8/1983 | Japan | 343/700 MS |
| 2131232 | 6/1984 | United Kingdom | 343/700 MS |

*Primary Examiner*—Rolf Hille
*Assistant Examiner*—Michael C. Wimer
*Attorney, Agent, or Firm*—Burns, Doane, Swecker & Mathis

[57] ABSTRACT

A planar antenna comprises a ground conductor plate, a power supply circuit and a radiation circuit. Each of those circuits is coated on both sides with synthetic resin layers. The circuits are separated from each other by a first air space. The power supply circuit and ground conductor plate are separated from each other by a second air space. Air present in the space operates as a low loss dielectric to achieve a high gain.

6 Claims, 3 Drawing Sheets

PLANAR ANTENNA

TECHNICAL BACKGROUND OF THE INVENTION

This invention relates to planar antennas and, more particularly, to a suspension type planar antenna of a tri-plate structure providing a high gain.

The planar antenna of the type referred to is effectively utilizable in receiving circularly polarized waves and the like which are transmitted as carried on SHF band, in particular, 12 GHz band from a geostationary broadcasting satellite launched into cosmic space to be 36,000 Km high from the earth.

DISCLOSURE OF PRIOR ART

Antennas generally used by listeners for receiving microwaves such as circularly polarized waves from the geostationary broadcasting satellite are parabolic antennas erected on the roofs of buildings. However, the parabolic antenna is susceptible to strong wind to easily fall down due to its bulky structure so that an additional means for stably supporting the antenna will be necessary, and the supporting means further requires high mounting cost, rendering antenna installation work difficult.

In an attempt to eliminate these problems of the parabolic antenna, there has been suggested in Japanese Patent Appln. Laid-Open Publication No. 99803/1982 (corresponding to U.S. Pat. No. 3,475,107 or to German Offenlegungsschrift No. 3149200) a planar antenna which is flattened in the entire configuration. This planar antenna can be simplified in structure, mounted directly on an outdoor wall or the like position of house buildings and made inexpensive.

On the other hand, the planar antenna is desired to be of a high gain, for which purpose various attempts to reduce insertion loss have been made. Disclosed in, for example, U.S. Pat. No. 4,477,823 to Michael A. Weiss is a planar antenna in which a first dielectric substrate having thereon a power-supply line circuit is fixedly mounted on a ground conductor, a second dielectric substrate having thereon a radiator circuit is arranged as separated from the first dielectric substrate to form a space between the both substrates. A honeycomb-shape dielectric is provided between the two dielectric substrates. This plane antenna is intended to reduce the insertion loss in contrast to any known antenna arrangement having the radiator and power-supply line circuits directly embedded in a dielectric layer, by disposing the radiator circuit within the space.

However, this arrangement of Weiss has had such a problem that the power-supply line circuit is provided not in the space but rather directly on the second dielectric substrate disposed on the ground conductor, so that the insertion loss in a zone of the power-supply line circuit is still large enough to adversely affect the function of the radiator circuit zone, which insertion loss of the antenna cannot be reduced to a satisfactory level. Further, there has been proposed an attempt to secure a space on the lower side of the radiator circuit by providing honeycomb-shaped dielectric between the two dielectric substrates, but this attempt has been defective in that, when the honeycomb is made of ordinary dielectric material, there arises a loss of a level close to that occurring when the circuit is inserted between the dielectric layers.

Further disclosed in French Pat. No. 2,544,920 by Emmanuel Rammos is a planar antenna which comprises three layers respectively of a metallic material or the like and having a plurality of cavities therein. In this case, the layers are arranged so that the cavities in the layers are aligned with each other in their thickness direction, the layers are spaced from each other by spacers disposed between them. Dielectric sheets each carrying a conductor circuit network formed thereon are disposed between the layers, so that the conductor circuit networks on the dielectric sheets are positioned in spaces between adjacent ones of the layers and part of terminal conductors of the circuit networks is positioned in the aligned cavities. According to this arrangement, air existing in the cavities or spaces between the layers are utilized as a dielectric to reduce the insertion loss.

The arrangement of Rammos, however, has had such a problem that the conductor circuit networks are exposed directly to air flowing from the exterior, which may result in that the conductor circuit networks are to be easily corroded and thus the antenna cannot have a sufficient durability. Further, there has arisen in the arrangement another problem that the metallic materials must be processed to secure the cavities and spaces, through a relatively complicated metal processing technique, and the manufacture has been troublesome enough to result in a high cost. Yet, the necessity of positioning the terminal conductors of the circuit networks in the cavities calls for a high precision work in forming the conductor circuit networks on the dielectric sheets, assembling the planar antenna, and installing the assembled antenna, and the manufacturing has been disadvantageously complicated in these respects, too.

TECHNICAL FIELD OF THE INVENTION

A primary object of the present invention is, therefore, to provide a planar antenna which is high in signal reception gain and durability with an effective prevention of corrosion of conductor circuit networks, and is of simplified structure for easy assembling and involves remarkably inexpensive manufacturing and installing costs.

According to the present invention, the above object is attained by providing a planar antenna having an antenna surface part for receiving circularly polarized waves or the like microwaves carried on SHF band by means of electromagnetic coupling.

A power-supply circuit is each formed and a radiation circuit of an electrically conductive material and coated on both sides with synthetic resin layers and are placed above a ground conductor coated on its top side by a synthetic resin layer. The radiation and power-supply circuits are spaced from each other and the power-supply circuit and ground conductor are spaced from each other.

Other objects and advantages of the present invention shall be made clear in the following description of the invention detailed with reference to preferred embodiments shown in accompanying drawings.

Figure 1:
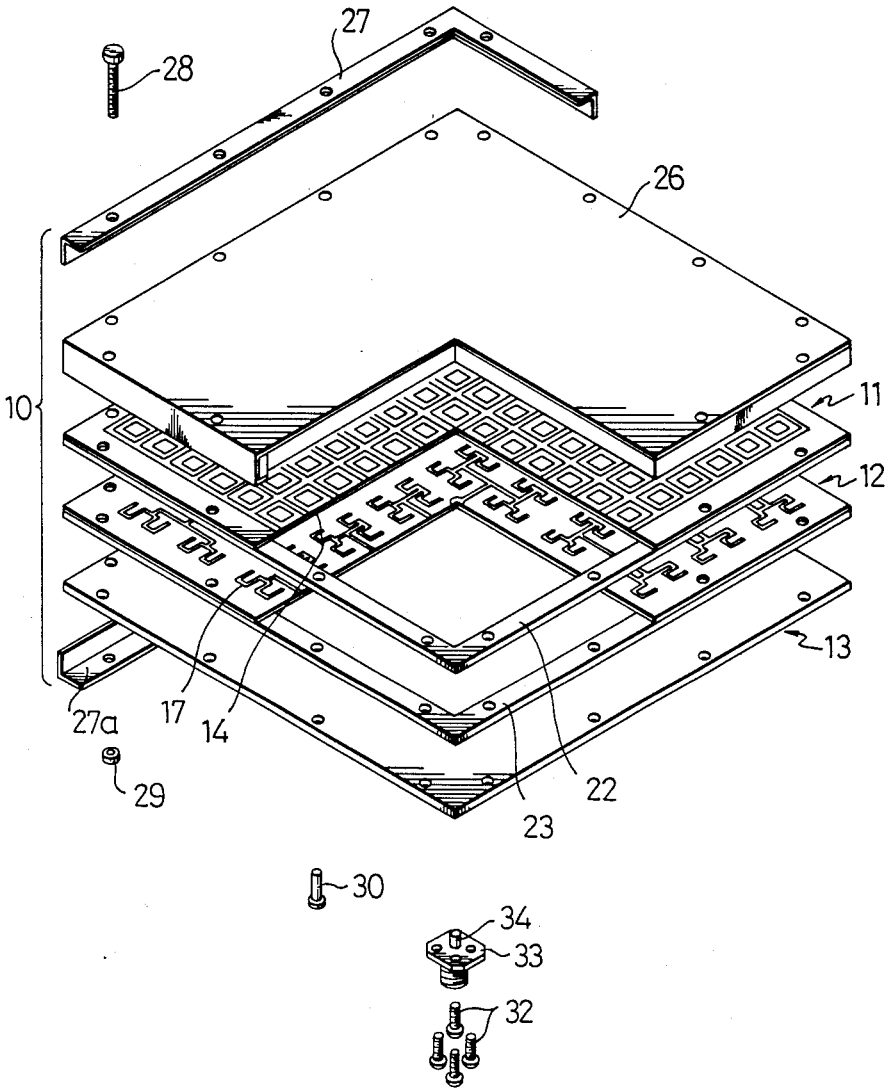
FIG. 1 is a perspective exploded view of main parts of a plane antenna in an embodiment according to the present invention.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 2:
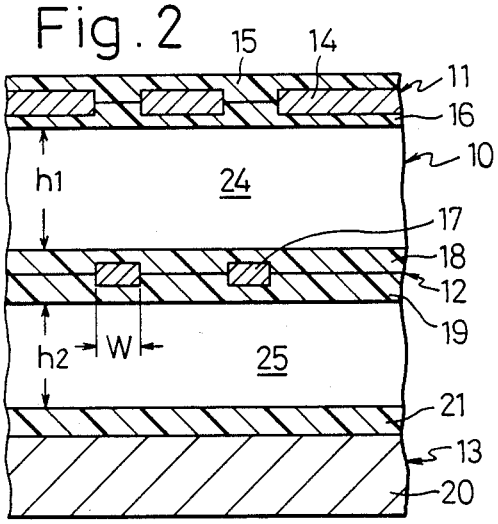
FIG. 2 is an enlarged fragmentary vertically sectioned view of the plane antenna of FIG. 1.

Referring to a planar antenna 10 in an embodiment according to the present invention shown in FIGS. 1 and 2, its antenna surface part comprises generally a radiation circuit plate 11, a power-supply circuit plate 12 and an ground conductor plate 13. In the present embodiment, the radiation and power-supply circuit plates 11 and 12 are formed respectively in a tri-plate construction to be sufficiently resistant to corrosion. More specifically, the radiation circuit plate 11 comprises a radiation circuit network 14 of such electrically conductive material as copper, aluminum, silver, astatine, iron, gold or the like, and synthetic resin layers 15 and 16 respectively stacked on upper and lower sides of the network 14. In other words, the radiation circuit network 14 is formed as sandwiched between the two synthetic resin layers 15 and 16, which layers may be made of such material as polyethylene, polypropylene, polyester, acrylic, polycarbonate, ABS resin or PVC resin, respectively alone or in a mixture of two or more.

The power supply circuit plate 12 also comprises a power-supply circuit network 17 made of the same electrically conductive material as the radiation circuit network 14, and synthetic resin layers 18 and 19 of the same material as the synthetic resin layers 15 and 16 of the radiation circuit plate 11 and respectively stacked on upper and lower sides of the network 17 to sandwich it. On the other hand, the ground conductor plate 13 comprises a ground conductor 20 of the same electrically conductive material as the radiation circuit network 14, which conductor 20 is, in the illustrated embodiment, coated with a synthetic resin layer 21 of the same material as the synthetic resin layers 15 and 16 of the radiation circuit plate 11, on one side opposing the power-supply circuit plate 12. While it is preferable that the ground conductor be coated with the resin layer 21, this coating may be omitted, or the coating layer 21 may be provided on both sides of the ground conductor 20.

Optimumly, the respective resin layers 15, 16, 18, 19 and 21 are solely comprised of the synthetic resin, rather than being reinforced by glass cloth or the like as in known flexible printed circuit boards, and are made to be less than 200 μm thick so as to minimize the insertion loss as far as possible. Further, the synthetic resin layers 15, 16, 18, 19 and 21 may be formed by applying a plastic paint onto the circuit networks 14, 17 and ground conductor 20 to be less than 200 μm thick, respectively. In all events, these layers 15, 16, 18, 19 and 21 are formed to exhibit a smaller dielectric constant and dielectric loss tangent.

Figure 6:
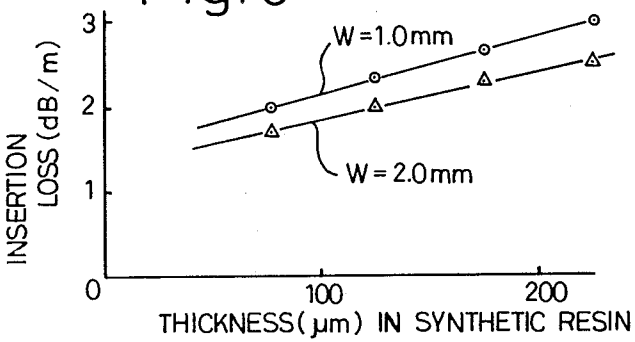
FIG. 6 is a diagram showing the relationship of the thickness of synthetic resin with which circuit networks are coated, to the insertion loss in the plane antenna of the present invention.

Referring also to FIG. 6, measurement of the insertion loss has been made with respect to sample planar antennas prepared for comparison, respectively with the conductor of the power-supply circuit network 17 varied in width W to be 1.0 mm and 2.0 mm and with the synthetic resin layers 15, 16, 18, 19 and 21 varied in thickness to be sequentially larger. The testing has shown that, in the case where the width W of the network conductor is 1.0 mm and the thickness of the synthetic resin layers exceeds 200 μm, in particular, the insertion loss approaches an unacceptably high value of 3 dB/m. Accordingly, the thickness of the synthetic resin layers should be generally below 200 μm and preferably below 100 μm for a high signal reception gain, though it should depend on the value of the width W of the network conductor.

Figure 3:
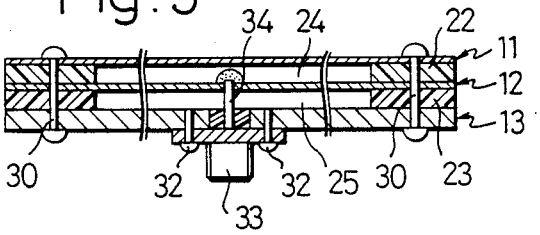
FIG. 3 is a schematic vertically sectioned view of another embodiment of the present invention.

Referring now also to FIG. 3, spacers 22 and 23 are disposed respectively between the radiation and power-supply circuit plates 11 and 12 and between the power supply-circuit and ground conductor plates 12 and 13. Those spacers 22 and 23 may be formed of a synthetic resin, metal, wood or the like material into any desired frame shape (while FIG. 1 shows only a rectangular shape) to be positioned between the respective plates 11, 12 and 13 as a spacing means, so that the plates 11, 12 and 12, 13 will be kept separated from each other by the spacers 22 and 23 to define spaces 24 and 25 between them. In the present case, gas, in particular air, flowing through the spaces 24 and 25 acts as a low loss dielectric, and this arrangement of the radiation and power-supply circuit plates 11 and 12 providing the spaces on their both sides forms one of the remarkable features of the present invention.

Figure 7:
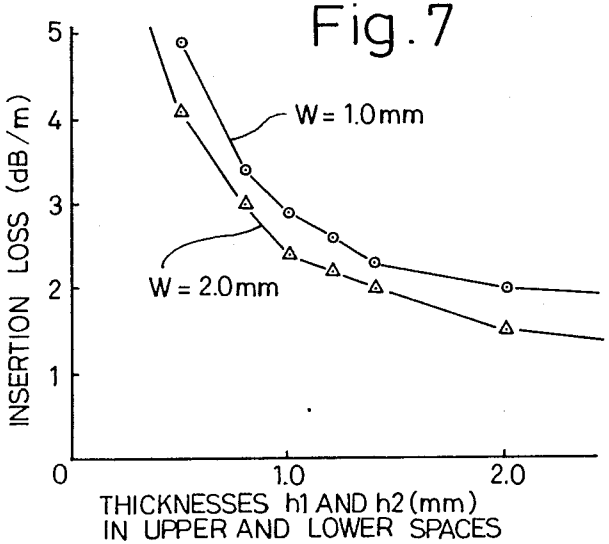
FIG. 7 is a diagram showing the relationship between the thickness of the space defined in the plane antenna and the insertion loss.

It has been further found that, when the spaces 24 and 25 are so provided with a thickness or height h1 and h2 larger than 0.5 mm and preferably more than 2 mm, a high gain can be obtained. More specifically, as shown in FIG. 7, the measurement of insertion loss has been carried out with respect to sample planar antennas prepared for comparison with the conductor of the power-supply circuit network 17 varied in thickness W to be 1.0 mm and 2.0 mm and with the height h1 and h2 of the spaces varies to be gradually larger. This testing proves that, in the both cases where the width W is 1.0 mm and 2.0 mm, (a) the insertion loss becomes too large when h1, h2 $<$ 0.5 mm, (b) the insertion loss is smaller than, for example, that of the foregoing known antenna of Weiss when h1, h2 $\geqq$ 1.0 mm, and (c) the insertion loss can be reduced to a large extent when h1, h2 $>$ 2 mm.

On the front side of the antenna surface assembly 11, 12, 13, 22, 23, a radome 26 is provided to cover the exposed surface of the radiation circuit plate 11. That radome 26 is made of a material permeable to the microwaves at least in a zone corresponding to the radiation circuit network 14 to protect the antenna surface. The antenna surface assembly thus covered with the radome 26 is provided at the periphery with a set of coupling frames 27 and 27*a* (only two of which are illustrated) so that all of the assembly elements can be firmly coupled together by means of a plurality of bolts 28 (only one is shown) inserted from above into holes made through the frames 27 and 27*a*, radome 26 and plates 11 to 13 and secured therein with nuts 29 (only one is shown) fastened to downward projected ends of the bolts 28. In this case, preferably, link pins 30 (only one is shown) are passed through a plurality of holes made through the radiation circuit, power-supply circuit and ground conductor plates 11 to 13 at their peripheral parts as well as the spacers 22 and 23 in alignment in their thickness direction with each other. The pins 30 are inserted through the lower side of the ground conductor plate 13. Upper ends of the pins 30 are caulked on the front face of the radiation circuit plate 11, whereby the three plates 11 to 13 and spacers 22 and 23 are interlinked to each other. Fixedly mounted on the ground conductor plate 13 at its appropriate position in an electrically non-conducting state with respect to the plate 13 is a power supply connector 33. The connector 33 is secured by screws 32 and connected to a power source circuit (not shown) and has a power supply pin 34 upwardly extended through the ground conductor plate 13 also in electrically non-conducting state with respect to the plate 13 but electrically connected to a power supply point of the circuit network 17 of the power-supply circuit plate 12.

Figure 4:
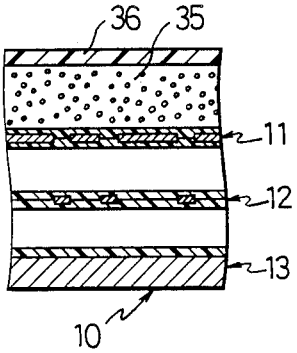
FIG. 4 is a schematic fragmental section through a plane antenna according to the present invention which includes a radome.

When the planar antenna 10 according to the present invention is installed outdoors, it is necessary to cover the antenna with radome 26 as mentioned above for protection of the antenna surface. In this connection, the radome may comprise, as shown in FIG. 4, a foamed plastic layer 35 directly provided on the front face of the plane antenna 10 and a synthetic resin layer 36 permeable to the microwaves and provided on the foamed plastic layer 35. In this case, a sufficient permeability to the microwaves is attained when the thickness of the foamed plastic layer 35 is more than 2 mm with a foaming extent of more than 5 times, and the thickness of the synthetic resin layer 36 is less than 1 mm. The synthetic resin layer 36 may be formed by applying a synthetic resin onto the foamed plastic layer 35. Depending on the installation environment, further, a radome that comprises only the foamed plastic layer 35 may even be employed without the synthetic resin layer 36.

In addition to protecting the antenna surface, the radome also improves the strength of the antenna 10, so that any reduction in the height of the spaces 24 and 25 between the respective plates 11, 12 and 13 under stress of wind and rain can be resisted to maintain the gain characteristic of the antenna for a long time, and the antenna can be of high reliability particularly with regard to avoiding weather-induced deterioration.

Figure 5:
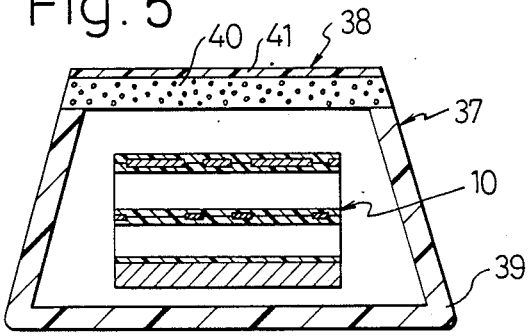
FIG. 5 is a schematic section for showing another type of radome according to the present invention.

Instead of a radome 26 covering only the antenna surface there may be used a radome 37 of a type enclosing therein the entire antenna 10 as shown in FIG. 5. In this case, the radome 37 comprises a surface region 38 disposed in front of the antenna 10 and permeable to the microwaves, and a body part 39 surrounding peripheral and bottom sides of the antenna 10 and impermeable to the microwaves. The permeable surface region 38 itself includes a foamed plastic layer 40 having a thickness of more than 2 mm and a foaming extent of more than 5 times, and a covering synthetic resin layer 41 having a thickness of less than 1 mm. The function and operation of the foamed plastic and covering layers 40 and 41 are substantially the same as those of the layers 35 and 36 in the embodiment of FIG. 4. The impermeable body part 39 is made of such material high in mechanical strength as, for example, metal, synthetic resin, reinforced synthetic resin, wood or the like alone or in a composite form of two or more of them.

The synthetic resin layers 36 and 41 in both embodiments of FIGS. 4 and 5 are made of preferably one or a copolymer or two or more of polycarbonate, polyethylene, polypropylene, PMMA, ABS, ASA, polyester, PVDF, fluoroplastic, or the like.

Now, the manufacturing procedure of the plane antenna according to the present invention shall be detailed with reference to certain examples to promote understanding of the invention.

EXAMPLE 1 a. A 35 μm thick copper foil is dry-laminated on a 100 μm thick sheet of polyethylene terephthalate (hereinafter referred to as "PET") by any existing method.

b. The copper foil of the step "a" is etched by an etching process to form a pattern of the radiation circuit network 14 or power-supply circuit network 17.

c. A 20 μm thick polyethylene sheet is dry-laminated on the circuit network pattern obtained in the step "b" to form the radiation circuit plate 11 or power-supply circuit plate 12.

d. A 20 μm thick polyethylene sheet is dry-laminated on a 2 mm thick aluminum plate (JIS Standard 1054H24) forming the earthing conductor 20 to prepare the earthing conductor plate 13.

e. A plurality of polycarbonate-made supports 2 mm high and 3 mm in diameter (which are different from the rectangular frame-shaped spacers 22 and 23 in the embodiment of FIG. 1) are erected on the earthing conductor plate 13 of the step "d" as spaced from each other by substantially 5 cm (if necessary, by rectangular frame-shaped spacers 22 and 23 may also be provided) to secure a required range of height for the space 25.

f. The radiation circuit plate 11 obtained in the step "c" is placed on the supports of the step "e" and another set of supports similar to those of the step "e" are erected on the radiation circuit plate 11 to secure a required range of height for the space 24.

g. The power supply circuit plate 12 obtained in the step "c" is placed on the supports of the step "f" to obtain an antenna surface of the plane antenna of a suspension type.

The thus obtained planar antenna 10 was compared with a known planar antenna of glass-reinforced Teflon substrates each carrying a circuit network formed as shown in FIG. 1, in respect of measurement of initial gain and gain after 6 months, as the well as observation of circuit state after 6 months, the results of which were as follows:

TABLE

| | Initial Gain | Gain after 6 mths. | Circuit State after 6 mths. |
|---|---|---|---|
| Antenna of Invention | 38 dB | 37 dB | No Corrosion |
| Known Antenna | 36.5 dB | 35.7 dB | Patina Developed on Copper (of circuit network) |

It will be appreciated from the above Table that the planar antenna according to the present invention shows a higher initial gain and a lower loss as compared with the known antenna. Further, under a wind pressure of about 10 m/sec, no reduction was observed in the gain of the antenna of the present invention, whereas the spaces 24 and 25 in the known antenna became smaller than the initially set height and the gain dropped to 0.7 dB. As a result, it has been found that the antenna of the present invention is excellent in its practical use.

EXAMPLE 2

A 50 μm thick PET film in place of the 100 μm thick PET film in the step "a" of EXAMPLE 1 and a 50 μm thick PET film in place of the 20 μm thick polyethylene film in the step "c" of EXAMPLE 1 were used to obtain as similar plane antenna.

The plane planar obtained in this EXAMPLE 2 has exhibited substantially the same properties as the planar antenna of Example 1.

EXAMPLE 3

The polycarbonate-made supports used in the steps "e" and "f" of EXAMPLE 1 were replaced by a grid-like spacer of polyethylene-polystyrene copolymer having a foaming extent of 5 times, a height of 2 mm and a grid specing of 5 cm, and a planar antenna using this spacer has shown substantially the same properties as the planar antenna of EXAMPLE 1.

EXAMPLES 4 AND 5

In place of the spacer used in EXAMPLE 3, a honeycomb-shaped spacer of polyethylene-polystyrene copolymer having a foaming extent of 5 times, a height of 2 mm and a parallel spacing of 5 cm was used to prepare a fourth planar antenna.

In place of the spacer used in EXAMPLE 3, a synthetic resin sheet having many small air cells or so-called air-caps over the entire surface of the sheet were used as spacers to prepare a fifth planar antenna.

Both of the fourth and fifth antennas have shown substantially the same properties as the antenna of EXAMPLE 1.

EXAMPLE 6

A 10 mm thick foamed plastic layer of polyethylene-polystyrene copolymer having a foaming extent of 30 times was provided on the front side of the plane antenna of EXAMPLE 1, and then a 0.5 mm thick polyester resin sheet reinforced with glass cloth having a density of 200 g/m$^2$ was bonded with polyester resin onto the front side surface of the foamed plastic layer.

A thus-obtained planar antenna was subjected to an outdoor exposure for about one year, but was not deteriorated in the properties. Further, the antenna was subjected to a wind of 20 m/sec, but the thickness of the spaces 24 and 25 was kept constant and the antenna exhibited a high reliability in the outdoor use.

EXAMPLE 7

In realizing the radome 37 shown in FIG. 5, the foamed plastic layer 40 of the permeable surface region 38 of the radome was made of a 10 mm thick foamed board of polyethylene-polystyrene copolymer having a foaming extent of 30 times, a 0.5 mm thick polyester resin sheet reinforced with glass cloth having a density of 200 g/m$^2$ was bonded with polyester resin onto the foamed board to form the synthetic resin layer 41 on the foamed board, and then impermeable body part 39 of the radome 37 was made of a 3 mm thick polyester resin casing reinforced with glass mat having a density of 450 g/m$^2$. The plane antenna prepared in EXAMPLE 1 was enclosed in the radome, while the known antenna explained in connection with EXAMPLE 1 was also housed in a similar radome.

As a result of measurement, the known antenna has shown development of patina on the circuit network copper due to corrosion after about 6 months, whereas the antenna according to the present invention was not subjected to any deterioration in the properties even after more than 2 years and was as durable in practical use as in EXAMPLE 6. Comparing the antenna of EXAMPLE 1 left naked with the antenna enclosed in the radome as in EXAMPLE 7, the former has shown a deterioration due to stress of weather in the PET layer after 2 years, whereas the latter has shown no deterioration in the same layer even through the weather stress given for 3 years.

Figure 8:
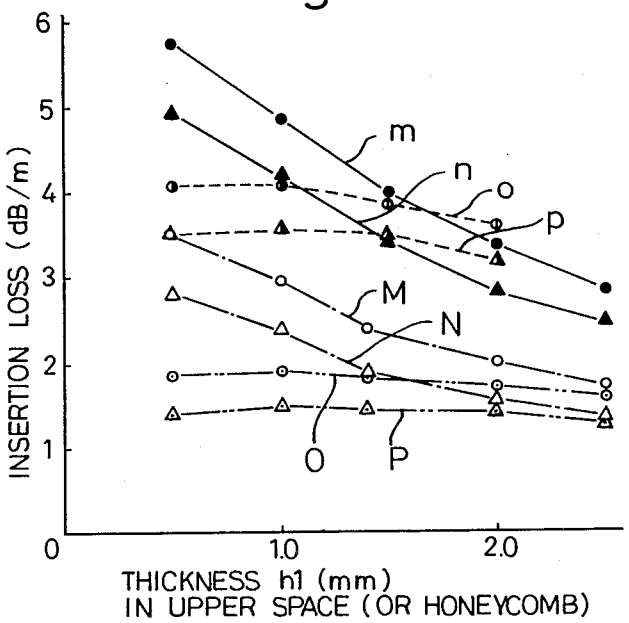
FIG. 8 is a diagram showing the relationship of the insertion loss to varying thickness of the upper space in plane antennas with a honeycomb disposed in the space according to another embodiment of the present invention and in known plane antennas using also the honeycomb.

In addition, the property comparison was made between the planar antenna of such arrangement as shown in FIGS. 1 and 2 according to the present invention and the known planar antenna of the foregoing Wise U.S. Pat. No. 4,477,813. In this case, the dielectric substrate of Wise which is formed on the earthing conductor and provided with the power-supply line circuit was made of Teflon showing the minimum loss. A plurality of the antennas of the present invention were prepared respectively with the lower space 25 differently set to be of the height of 0.8 mm and 2.0 mm and with the width W of the electrically conductive material of the power-supply circuit network 17 also differently set to be 1.0 mm and 2.0 mm, while the height of their upper space 24 was gradually increased. A plurality of the known antennas of Wise were prepared respectively with the Teflon dielectric substrate varied in thickness to be 0.8 mm and 2.0 mm and with the conductor width W of the power-supply circuit network varied at 1.0 mm and 2.0 mm, while the height of the honeycomb was gradually increased. Results of similar measurement for the comparison are as shown in FIG. 8, in which the measurement for the antennas of the present invention is denoted by single-dot and double-dot chain line M, N, O and P (M and N being for the ones of both the lower space of 0.8 mm high but respectively of the width W of 1.0 mm and 2.0 mm; O and P being for the ones of both the lower space of 2.0 mm high but respectively of the width W of 1.0 mm and 2.0 mm), whereas the measurement of the known antennas is denoted by solid and dotted lines m, n, o and p (m and n being for the ones of both the Teflon substrate thickness of 0.8 mm but respectively of the width W of 1.0 mm and 2.0 mm; o and p being for the ones of both the Teflon substrate thickness of 2.0 mm but respectively of the width W of 1.0 mm and 2.0 mm).

As will be clear from FIG. 8, the planar antenna according to the present invention can reduce the insertion loss remarkably and successfully achieve a higher gain than in the case of the known planar antenna of Wise.

What is claimed as our invention is:

1. An antenna of generally planar configuration having an antenna surface for receiving incident microwaves transmitted from a geostatic broadcasting satellite on SHF band, said antenna comprising:

a planar radiation circuit of electrically conductive material disposed between and supported by two layers of synthetic resin material, said radiation circuit forming first and second surfaces, said first surface defining said antenna surface, a planar power supply circuit formed of patches of electrically conductive material disposed between and supported by two layers of synthetic resin material, said power supply circuit having a power supply point and forming third and fourth surfaces, said third surface facing said second surface, a planar ground conductor forming a fifth surface facing said fourth surface and defining an electrical ground for said radiation and power supply circuits, and first spacing means for separating said radiation and power supply circuits from one another in a manner forming a first space therebetween, second spacing means separating said power supply circuit and said ground conductor from one another in a manner forming a second space therebetween, said radiation circuit being electromagnetically coupled to said power supply circuit through said first space in response to an antenna-actuating power supply.

2. A planar antenna according to claim 1, wherein said synthetic resin layers supporting said radiation and power-supply circuits are each less than 200 μm thick.

3. A planar antenna according to claim 1, wherein each of said first and second spaces is more than 0.55 mm high.

4. A plane antenna according to claim 1, wherein each of said spacing means comprises a frame formed of a material selected from a group consisting of metal, synthetic resin and wood.

5. A planar antenna according to claim 4, wherein each of said spacing means comprises a plurality of supports made of synthetic resin.

6. A planar antenna according to claim 1, wherein a synthetic resin layer coats said fifth surface.

* * * * *

UNITED STATES PATENT AND TRADEMARK OFFICE

CERTIFICATE OF CORRECTION

PATENT NO. : 4,851,855

DATED : July 25, 1989

INVENTOR(S) : Katsuya Tsukamoto, Kyozi Masamoto, Yasuhiro Fujii and Yoshihiro Kitsuda It is certified that error appears in the above-identified patent and that said Letters Patent is hereby corrected as shown below:

In column 9, line 3, delete "formed of patches".

Signed and Sealed this

Twenty-second Day of May, 1990

*Attest:*

HARRY F. MANBECK, JR.

*Attesting Officer*

*Commissioner of Patents and Trademarks*